US008952612B1

(12) United States Patent
Pavliscak et al.

(10) Patent No.: US 8,952,612 B1
(45) Date of Patent: Feb. 10, 2015

(54) MICRODISCHARGE DISPLAY WITH FLUORESCENT CONVERSION MATERIAL

(75) Inventors: Thomas J. Pavliscak, Palos Verdes, CA (US); Edwin F. Peters, Toledo, OH (US); Carol Ann Wedding, Toledo, OH (US); Oliver M. Strbik, III, Holland, OH (US)

(73) Assignee: Imaging Systems Technology, Inc., Toledo, OH (US)

( * ) Notice: Subject to any disclaimer, the term of this patent is extended or adjusted under 35 U.S.C. 154(b) by 1564 days.

(21) Appl. No.: 12/131,054

(22) Filed: May 31, 2008

Related U.S. Application Data

(63) Continuation-in-part of application No. 11/855,241, filed on Sep. 14, 2007, now abandoned.

(60) Provisional application No. 60/844,641, filed on Sep. 15, 2006.

(51) Int. Cl.
*H01J 17/49* (2012.01)

(52) U.S. Cl.
USPC ..... 313/582; 313/585

(58) Field of Classification Search
USPC ..... 313/483, 486, 491, 493, 495–497, 313/582–587
See application file for complete search history.

(56) References Cited

U.S. PATENT DOCUMENTS 3,623,907 A 11/1971 Watts
3,634,614 A 1/1972 Geusic et al.
3,769,543 A * 10/1973 Pennebaker ..... 315/169.4
3,836,810 A * 9/1974 Johanns et al. ..... 313/484
3,838,307 A * 9/1974 Masi ..... 313/486
3,848,248 A * 11/1974 MacIntyre, Jr. ..... 345/60
5,166,948 A 11/1992 Gavrilovic et al.
5,438,343 A 8/1995 Khan et al.
5,541,012 A 7/1996 Ohwaki et al.
5,629,953 A 5/1997 Bishop et al.
6,016,027 A 1/2000 DeTemple et al.
6,028,977 A 2/2000 Newsome
6,139,384 A 10/2000 DeTemple et al.

(Continued)

OTHER PUBLICATIONS

A.D. White, "New Hollow Cathode Glow Discharge", Journal of Applied Physics, vol. 30, No. 5, May 1959, pp. 711-719.

(Continued)

*Primary Examiner* — Elmito Breval
(74) *Attorney, Agent, or Firm* — Donald K. Wedding

(57) ABSTRACT

An AC or DC microdischarge device that comprises a fluorescent conversion material (FCM) and a multiplicity of gas filled microcavity cells, each cell being connected to two or more electrodes to cause a gas discharge in the cell, the gas discharge providing photons that excite the FCM such that the FCM emits IR. In one embodiment, the electronic circuitry for each cell comprises at least one integrated active component such as a transistor. Other active components may be included such as a high speed shift register, addressing logic, and/or control circuits. In another embodiment, the microcavity and active components are made from the same substrate such as the same silicon wafer. The microdischarge device may include one or more electrodes encapsulated in a dielectric. The electrodes are configured to ignite a microdischarge in a microcavity cell when an AC or a pulsed DC excitation potential is applied between the electrodes connected to the cell. The devices include linear and planar arrays of microdischarge devices. The microcavities in the planar arrays may be selectively excited for display applications.

16 Claims, 8 Drawing Sheets

(56) References Cited

U.S. PATENT DOCUMENTS

| | | | |
|---|---|---|---|
| 6,194,833 | B1 | 2/2001 | DeTemple et al. |
| 6,265,825 | B1 | 7/2001 | Asano |
| 6,348,125 | B1 | 2/2002 | Geusic et al. |
| 6,504,645 | B1 | 1/2003 | Lenz et al. |
| 6,534,916 | B1 | 3/2003 | Ito et al. |
| 6,541,915 | B2 | 4/2003 | Eden et al. |
| 6,563,257 | B2 | 5/2003 | Vojak et al. |
| 6,579,803 | B2 | 6/2003 | Geusic et al. |
| 6,593,656 | B2 | 7/2003 | Ahn et al. |
| 6,602,653 | B1 | 8/2003 | Geusic et al. |
| 6,624,414 | B1 | 9/2003 | Glesener |
| 6,657,370 | B1 | 12/2003 | Geusic |
| 6,695,664 | B2 | 2/2004 | Eden et al. |
| 6,726,992 | B1 | 4/2004 | Yadav et al. |
| 6,765,220 | B2 | 7/2004 | Kongable et al. |
| 6,812,909 | B1 | 11/2004 | Crossland |
| 6,815,891 | B2 | 11/2004 | Eden et al. |
| 6,828,730 | B2 | 12/2004 | Eden et al. |
| 6,867,548 | B2 | 3/2005 | Eden et al. |
| 6,928,227 | B2 | 8/2005 | Shaw et al. |
| 6,972,257 | B2 | 12/2005 | Geusic et al. |
| 6,998,787 | B2 | 2/2006 | Geusic |
| 7,019,795 | B2 | 3/2006 | Jones |
| 7,025,646 | B2 | 4/2006 | Geusic |
| 7,061,463 | B2 | 6/2006 | Crossland et al. |
| 7,084,067 | B2 | 8/2006 | Geusic et al. |
| 7,098,420 | B2 | 8/2006 | Crowe et al. |
| 7,109,488 | B2 | 9/2006 | Milton |
| 7,112,918 | B2 | 9/2006 | Eden et al. |
| 7,126,266 | B2 | 10/2006 | Park et al. |
| 7,133,590 | B2 | 11/2006 | Shaw et al. |
| 7,141,920 | B2 | 11/2006 | Oskam et al. |
| 7,153,775 | B2 | 12/2006 | Geusic et al. |
| 7,223,959 | B2 | 5/2007 | Fuller |
| 7,235,493 | B2 | 6/2007 | Qin |
| 7,276,699 | B2 | 10/2007 | Essex |
| 7,297,041 | B2 | 11/2007 | Eden et al. |
| 7,372,202 | B2 | 5/2008 | Eden et al. |
| 2002/0003048 | A1* | 1/2002 | Chikama et al. ..... 174/256 |
| 2002/0113553 | A1 | 8/2002 | Vojak et al. |
| 2003/0080664 | A1 | 5/2003 | Eden et al. |
| 2003/0080688 | A1 | 5/2003 | Eden et al. |
| 2003/0132693 | A1 | 7/2003 | Eden et al. |
| 2003/0213923 | A1 | 11/2003 | Kongable et al. |
| 2004/0037538 | A1 | 2/2004 | Schardt et al. |
| 2004/0100194 | A1 | 5/2004 | Eden et al. |
| 2004/0160162 | A1 | 8/2004 | Eden et al. |
| 2005/0105580 | A1 | 5/2005 | Giapis et al. |
| 2005/0148270 | A1 | 7/2005 | Eden et al. |
| 2005/0163958 | A1* | 7/2005 | Nakatsugawa ..... 428/40.1 |
| 2005/0171421 | A1 | 8/2005 | Eden et al. |
| 2005/0269953 | A1 | 12/2005 | Eden et al. |
| 2006/0012277 | A1 | 1/2006 | Park et al. |
| 2006/0038490 | A1 | 2/2006 | Eden et al. |
| 2006/0039844 | A1 | 2/2006 | Gutson et al. |
| 2006/0071598 | A1 | 4/2006 | Eden et al. |
| 2006/0082319 | A1 | 4/2006 | Eden et al. |
| 2006/0251369 | A1 | 11/2006 | Shaw et al. |
| 2007/0014318 | A1 | 1/2007 | Hajjar et al. |
| 2007/0108910 | A1 | 5/2007 | Eden et al. |
| 2007/0170866 | A1 | 7/2007 | Eden et al. |
| 2007/0200499 | A1 | 8/2007 | Eden et al. |
| 2008/0036383 | A1* | 2/2008 | Lin ..... 313/634 |
| 2008/0119105 | A1 | 5/2008 | Eden et al. |

OTHER PUBLICATIONS

K.H. Schoenbach, et al., "Microhollow Cathode Discharges", Applied Physics Letters, 68(1), Jan. 1, 1996, pp. 13-15.

Kyung Cheol Choi, "Microdischarge in microbridge plasma display with holes in the cathode", IEEE Electron Device Letters, vol. 19, Issue 6, Jun. 1998, pp. 186-188.

* cited by examiner

MICRODISCHARGE DISPLAY WITH FLUORESCENT CONVERSION MATERIAL

RELATED APPLICATIONS

This application is a continuation-in-part under 35 U.S.C. 120 of copending U.S. patent application Ser. No. 11/855,241, filed Sep. 14, 2007, now abandoned which claims priority under 35 U.S.C. 119(e) for U.S. Provisional Application Ser. No. 60/844,641, filed Sep. 15, 2006.

FIELD OF INVENTION

This invention relates to an open cell or closed cell AC or DC microdischarge plasma display having a multiplicity of microcavity cells and containing a fluorescent conversion material (FCM) that produces infrared (IR) when excited by photons from the gas discharge. This invention also relates to a microdischarge gas plasma display having at least one active component provided for each microcavity cell.

In one embodiment, the microdischarge display is operated with high gray scale at high frequency. In one embodiment there is provided a closed cell AC microdischarge plasma display having 1,000 levels of gray at 1,000 frames per second operation with an open drain, low capacitance IC output in series with each single AC microdischarge cell and a high voltage common AC driving source. With AC mode operation each closed cell microdischarge pixel has at least one of its electrodes enclosed within a dielectric barrier. When the IC output is ON, all the AC voltage from the source is seen across the individual microdischarge cell which has enough amplitude to quickly turn ON (ionize) the microdischarge cell. When the output is OFF, the combination of AC microdischarge cell capacitance in series with the OFF open drain capacitance is such that most of the source voltage appears across the open drain output, and therefore, the microdischarge cell turns off. The microdischarge cells in this case are AC devices and therefore produce high luminance only when driven with high frequency and high voltage excitation.

The FCM contained within the device is excited by photons from the gas discharge and emits IR. In another embodiment, there is provided a DC microdischarge PDP having a high level of grayscale at high frequency. In such embodiment, there is provided a DC microdischarge PDP having 1,000 levels of gray at 1,000 frames per second operation using an open drain, low capacitance, current limited IC output in series with each microdischarge cell and a high voltage common DC driving source. The FCM contained within the device is excited by photons from the gas discharge and emits IR.

BACKGROUND OF THE INVENTION

PDP Structures and Operation

A gas discharge plasma display panel (PDP) comprises a multiplicity of single addressable picture elements, each element being referred to as a cell or pixel. In a multicolor PDP, two or more cells or pixels may be addressed as sub-cells or sub-pixels to form a single cell or pixel. As used herein cell or pixel means sub-cell or sub-pixel. Two or more electrodes positioned in such a way so as to provide a voltage potential across a gap containing an ionizable gas define the cell or pixel element. In an AC PDP the electrodes are insulated from the gas by a dielectric. In a DC PDP the electrodes are in contact with the gas. When sufficient voltage is applied to the electrodes, the gas ionizes to produce light. The electrodes are generally grouped in a matrix configuration to allow for selective addressing of each cell or pixel.

The voltage at which a pixel will ionize depends on a number of factors including the distance between the electrodes, the composition of the ionizing gas, and the pressure of the ionizing gas. To maintain uniform electrical characteristics throughout the display, it is desired that the various physical parameters adhere to required tolerances. Maintaining the required tolerance depends on display structure, cell geometry, fabrication methods, and the materials used. The prior art discloses a variety of plasma display structures, cell geometries, methods of construction, and materials.

Dual Substrate AC PDP

In a dual substrate AC gas discharge display, there are two opposing substrates with opposing electrode arrays on each substrate, each cross over of opposing electrodes defining a pixel. The electrodes at each pixel site are coated with a dielectric. AC gas discharge devices include both monochrome (single color) AC plasma displays and multi-color (two or more colors) dot matrix AC plasma displays. Examples of dual substrate monochrome AC gas discharge (plasma) displays are well known in the prior art and include those disclosed in U.S. Pat. No. 3,559,190 (Bitzer et al.), U.S. Pat. No. 3,499,167 (Baker et al.), U.S. Pat. No. 3,860,846 (Mayer), U.S. Pat. No. 3,964,050 (Mayer), U.S. Pat. No. 4,080,597 (Mayer), U.S. Pat. No. 3,646,384 (Lay), and U.S. Pat. No. 4,126,807 (Wedding), all incorporated herein by reference. Examples of dual substrate multicolor AC plasma displays are well known in the prior art and include those disclosed in U.S. Pat. No. 4,233,623 (Pavliscak), U.S. Pat. No. 4,320,418 (Pavliscak), U.S. Pat. No. 4,827,186 (Knauer et al.), U.S. Pat. No. 5,661,500 (Shinoda et al.), U.S. Pat. No. 5,674,553 (Shinoda et al.), U.S. Pat. No. 5,107,182 (Sano et al.), U.S. Pat. No. 5,182,489 (Sano), U.S. Pat. No. 5,075,597 (Salavin et al.), U.S. Pat. No. 5,742,122 (Amemiya et al.), U.S. Pat. No. 5,640,068 (Amemiya et al.), U.S. Pat. No. 5,736,815 (Amemiya), U.S. Pat. No. 5,541,479 (Nagakubi), U.S. Pat. No. 5,745,086 (Weber) and U.S. Pat. No. 5,793,158 (Wedding), all incorporated herein by reference.

Dual Substrate DC PDP

A DC gas discharge display may comprise a structure with two opposing substrates, a so-called dual or co-planar device, as shown in AC PDP and DC PDP references cited herein.

Dual substrate dot matrix DC PDPs may comprise an apertured center plate sandwiched between a pair of opposing substrates with DC gas discharge cells or pixels being defined by the apertures. The center plate comprises a matrix of DC cells or pixels with each DC cell or pixel being defined by an aperture, perforation, hole, or like opening in the center plate. In some variations, the openings are longitudinal such as channels, slots, or grooves. In other variations, the apertures, perforations, holes, channels, slots, etc. are on one or both of the opposing dual substrates with or without a center plate.

Examples of dual substrate DC PDPs are disclosed in U.S. Pat. No. 3,553,458 (Schagen), U.S. Pat. No. 3,558,975 (Ogle), U.S. Pat. No. 3,600,626 (Kupsky), U.S. Pat. No. 3,629,638 (Veron), U.S. Pat. No. 3,644,925 (Kupsky), U.S. Pat. No. 3,683,364 (Holz et al.), U.S. Pat. No. 3,689,910 (Glaser), U.S. Pat. No. 3,704,386 (Cola), U.S. Pat. No. 3,766,420 (Ogle et al.), U.S. Pat. No. 3,788,722 (Milgram), U.S. Pat. No. 3,886,390 (Maloney et al.), U.S. Pat. No. 3,921,021 (Glaser et al.), U.S. Pat. No. 3,956,667 (Veith), U.S. Pat. No. 4,010,395 (Holz), U.S. Pat. No. 4,035,689 (Ogle et al.), U.S.

Pat. No. 4,297,613 (Aboelfotoh), U.S. Pat. No. 4,329,616 (Holz et al.), U.S. Pat. No. 4,329,626 (Hillenbrand et al.), U.S. Pat. No. 4,340,840 (Aboelfotoh et al.), U.S. Pat. No. 4,388,550 (de Vries), U.S. Pat. No. 4,393,326 (Kamegaya et al.), U.S. Pat. No. 4,532,505 (Holz et al.), U.S. Pat. No. 6,160,348 (Choi), U.S. Pat. No. 6,428,377 (Choi), and Reissue 29,629 (Ogle), all incorporated herein by reference.

Single Substrate PDP

A PDP structure may comprise a so-called single substrate or monolithic plasma display panel structure having one substrate with or without a top or front viewing envelope or dome. Single-substrate or monolithic plasma display panel structures are known in the prior art and are disclosed by U.S. Pat. No. 3,646,384 (Lay), U.S. Pat. No. 3,652,891 (Janning), U.S. Pat. No. 3,666,981 (Lay), U.S. Pat. No. 3,811,061 (Nakayama et al.), U.S. Pat. No. 3,860,846 (Mayer), U.S. Pat. No. 3,885,195 (Amano), U.S. Pat. No. 3,935,494 (Dick et al.), U.S. Pat. No. 3,964,050 (Mayer), U.S. Pat. No. 4,106,009 (Dick), U.S. Pat. No. 4,164,678 (Biazzo et al.), and U.S. Pat. No. 4,638,218 (Shinoda), all incorporated herein by reference. A single substrate PDP may be an AC or DC PDP.

Segmented PDP

A segmented PDP electrode structure is disclosed by U.S. Pat. No. 3,764,429 (Janning), U.S. Pat. No. 3,914,643 (Kupsky), and U.S. Pat. No. 3,944,868 (Kupsky), all incorporated herein by reference. In this structure, the electrodes or conductors form a figure 8 pattern with various electrode segments being turned on to form any numeral from 0 to 9. If diagonal bars are added to make a so-called British flag, alphabetical characters can also be formed, for example as disclosed in U.S. Pat. No. 6,408,988 (Hani et al.), incorporated herein by reference. A segmented display may also be structured to provide Arabic writing, for example as disclosed by U.S. Pat. No. 4,261,126 (Bezjian) incorporated herein by reference. The segmented PDP may be an AC PDP or DC PDP.

RELATED PRIOR ART

Backplane

In one embodiment of this invention, there is provided a microdischarge gas plasma display device having an integrated backplane of active components such microcavity cell having at least one active component. The following prior art references are examples of active backplane applications and are incorporated herein by reference: U.S. Pat. No. 7,019,795 (Jones); U.S. Pat. No. 7,061,463 (Crossland et al.); and U.S. Pat. No. 6,812,909 (Crossland).

Methods of Producing Microdischarge Cell Display

The following references disclose methods for the manufacture of microdischarge cell devices and are incorporated herein by reference. U.S. Pat. No. 7,098,420 (Crowe et al.), U.S. Pat. No. 7,025,646 (Geusic), U.S. Pat. No. 6,998,787 (Geusic), U.S. Pat. No. 6,657,370 (Geusic), U.S. Pat. No. 6,541,915 (Eden et al.), U.S. Patent Application 2006/0039844 (Gutson et al.), and U.S. Patent Application 2006/0038490 (Eden et al.), relate to microdischarge cell displays and are incorporated herein by reference.

The following microdischarge cell patents disclose a sealed light-transmissive cap that seals the microdischarge cavity and are incorporated herein by reference: U.S. Pat. No. 6,194,833 (DeTemple et al.); U.S. Pat. No. 6,139,384 (DeTemple et al.); U.S. Pat. No. 6,016,027 (DeTemple et al.).

The following microdischarge patents and patent applications disclose encapsulated electrodes and are incorporated herein by reference: U.S. Pat. No. 6,867,548 (Eden et al.); U.S. Pat. No. 6,828,730 (Eden et al.); U.S. Pat. No. 6,815,891 (Eden et al.); U.S. Pat. No. 6,695,664 (Eden et al.); U.S. Pat. No. 6,563,257 (Vojak et al.); U.S. Patent Application Nos. 2006/0082319 (Eden et al.); 2006/0071598 (Eden et al.); 2006/0012277 (Park et al.); 2005/0269953 (Eden et al.); 2005/0171421 (Eden et al.); 2005/0148270 (Eden et al.); 2004/0160162 (Eden et al.); 2004/0100194 (Eden et al.), 2003/0132693 (Eden et al.); 2003/0080688 (Eden et al.); 2003/0080664 (Eden et al.); and 2002/0113553 (Vojak et al.).

PRIOR ART DISCUSSION

Discharge lamps of different forms have been in use for about a century. Today, gas discharge lamps, such as mercury vapor, sodium vapor, and metal halide lamps, continue to represent a substantial portion of the lighting industry. Typically, the lamps are formed from a sealed vessel, which holds the vapor or gas, and are electrically excited by a voltage applied between metal electrodes. However, conventional lamps suffer from several drawbacks, one of which is the maximum operating gas (or vapor) pressure. For some lamps such as arc lamps, the pressure is limited by the strength of the vessel material, which must be transparent or translucent to create an effective light source. Others, such as hollow cathode lamps, have a maximum gas pressure at which hollow cathode discharge operation can be achieved. Generally fabricated in metals, hollow cathodes for conventional discharge lamps typically have diameters on the order of millimeters or centimeters and are normally limited to operation at pressures of a few Torr.

One approach to addressing these limitations for high-pressure arc lamps is proposed in U.S. Pat. No. 5,438,343 (Khan et al.), which contemplates a large number of microcavities, each of which can operate at a higher pressure than a single large cavity. The microcavities are formed by wafer bonding of two micromachined substrates of fused quartz, sapphire, glass or other transparent or translucent material. Cavities in the separate substrates align to form vessels for containing a gas or other "filler" (e.g., metal, metal-halide, etc.) after the substrates are bonded. While a radio frequency (RF) "electrodeless" embodiment is disclosed, other embodiments include etched recesses adjacent to the vessels in one or both of the substrates for accommodating separate metal electrodes. After the electrodes are deposited or otherwise placed in the recesses to electrically contact the discharge medium, the separate substrates are bonded together by Van der Waal's forces.

Separate plugs are required at the point where the electrode connections enter the vessel wall to maintain the vacuum integrity of the device. The plug material, which may be glass, is deposited over metal electrodes to reinforce the microcavity, which is weakened by the recess necessary to accommodate a separate electrode. Together, the reliance on Van der Waal's forces to bond separate substrates and the need for reinforcing plugs significantly complicate the production of the device. Another difficulty with the lamp devised by Khan et al. concerns the substrate material itself. Sapphire, fused quartz and other materials used in U.S. Pat. No. 5,438,343 for transparent or translucent substrates are brittle and difficult to process. The operation of the Khan device is also limited to a positive column discharge by the device geometry.

Others have proposed cavities in hollow metal cathodes having diameters as small as approximately 1 mm. As early as 1959, White, "New Hollow Cathode Glow Discharge," Applied Physics Letters, 30, 711 (1959), examined hollow cathode devices having typical diameters of 750 μm formed in a variety of metals, including molybdenum and niobium. More recently, Schoenbach et al., "Microhollow Cathode Discharges," *Applied Physics Letters,* 68, 13 (1996), produced and studied hollow cathode lamps having cavities with diameters of approximately 700 μm machined in molybdenum and insulators made of mica. However, the processes used to produce cavities having diameters of approximately 700 μm in bulk metals are not conducive to mass production or to the fabrication of arrays of microdischarges. In addition, sputtering of the metal cathode limits device lifetime.

Schoenbach et al. also recognized the benefit of cavities smaller than 700 μm. Although Schoenbach et al. reported an effective cavity of 75 μm in molybdenum, this structure consisted of a machined hole having a diameter on the order of 700 μm forming most of the cathode, and a smaller 75 μm cathode opening, thus producing a microcavity aperture only at the top of the device. This arrangement would not lend itself to the mass production of inexpensive devices, and it is not clear that the performance characteristics of such a two-section cathode would be similar to a true microcavity cathode having a maximum diameter from about 500 μm down to about a single micrometer. Another concern with metal cathode devices is the formation of metal-bearing compounds (including the metal halides) that are a byproduct of the reaction of various metals with some discharge media that are useful, such as the halogens.

These issues have important implications for a variety of microdischarge applications, and their potential as displays and lighting sources, in particular. The leading candidates currently being pursued for high-resolution displays are liquid crystals, field emission devices, and plasma panels. Large area displays have largely been the domain of plasma panels, which are now available in 42" diagonal displays. However, plasma panels present formidable manufacturing challenges stemming from the materials employed and the approach that has been adopted for producing the display. Discharge gaps, typically 100 to 300 μm in commercial devices, are defined by the spacing between metal electrodes, one of which is often a wire (see, for example, Kyung Cheol Choi, "Microdischarge in microbridge plasma display with holes in the cathode," *IEEE Electron Dev. Lett.* 19, 186 (1998)). Precisely constructing a multiplicity of microdischarge devices so that the discharge gap does not vary significantly among the discharges is a difficult task.

Other display technologies suffer from several drawbacks. Despite their use in portable and desktop computer displays, liquid crystals are limited in brightness and offer a restricted viewing angle. Field emission devices rely on processing silicon pyramidal structures by VLSI fabrication techniques. These devices produce a weak current when a voltage is applied between the tip of the silicon pyramid (or cone) and an electrode (anode). The magnitude of the emission current is sensitive to the gap between the two, which, combined with the requirement that the device operate in a vacuum, mandates sophisticated manufacturing processes and has thus far limited the sizes of field emission displays to typically 5-10 inches (along the diagonal).

THE INVENTION

In accordance with this invention, there is provided an AC or DC microdischarge cell device comprised of a multiplicity of microcavity cells, the device containing FCM that produces IR when excited by photons from the gas discharge within a microcavity cell. The device also contains an integrated active backplane with active components such as transistors, each AC or DC microcavity cell being formed and integrated in series with an active component.

In accordance with this invention, each AC or DC microcavity cell is in electrical contact with an integrated active component such as a transistor. In addition to one or more transistors at each microcavity discharge cell, there may be other advantageous active components such as, high speed shift register and/or addressing logic, and control circuitry so as to bring image and control signals to all the driver transistors via a much reduced pin count interface. The microcavity and active components may be made from the same substrate such as the same silicon wafer.

In one embodiment, there is provided at least one AC microdischarge PDP with a multiplicity of microcavity cells and an integrated backplane of active components, at least two electrodes being in electrical contact with each cell, and at least one electrode being encapsulated with a dielectric. In an AC device all electrodes connected to each cell are typically encapsulated with dielectric. An active component is provided for each cell of the AC microdischarge PDP. Typically this active component is a field effect transistor (FET). In one embodiment, it is an open drain FET.

In another embodiment of this invention, there is provided a DC microdischarge device with a multiplicity of microcavity cells and a backplane of active components. In a DC device, the electrodes are not encapsulated with a dielectric. At least one active component is provided for each cell. The active component may be a bipolar transistor. In one embodiment, it is an open collector bipolar transistor. The active component may also be a field effect transistor (FET). In one embodiment, it is an open drain FET.

This invention provides an improved microdischarge device that eliminates limitations and disadvantages associated with the manufacture and performance of prior art displays. In one embodiment of this invention, there is provided an improved microdischarge device with a multiplicity of microcavity cells, with each microcavity cell in a silicon substrate that contains a conductive medium such as gas or vapor, wherein the medium is electrically connected to at least one active component such as a transistor formed in the silicon with the microcavity.

In another embodiment, there is provided an improved DC microdischarge device comprising a multiplicity of microcavity cells penetrating a dielectric and a planar metallized (or semiconductor) anode, and extending from a planar semiconductor cathode, each microcavity containing a conductive filler, such as gas or vapor, and the filler is electrically contacted by the semiconductor cathode.

Another embodiment of the invention provides an improved DC microdischarge display including a multiplicity of microcavity cells in a silicon substrate (or silicon film on an insulating substrate such as glass) which contains a conductive filler, the filler being electrically contacted by one or more semiconductor electrodes formed in the silicon, wherein the display is operable as a hollow cathode discharge at a pd product (pressure×diameter) exceeding approximately 20 Torr-mm, depending on the selected ratio of the cavity length to the cavity aperture.

Wave guides formed above the planar arrays provide a preferred additional aspect of the invention to collect and utilize the light produced by the arrays. A grating or other structure may be used to collect light from hundreds or thousands of individual discharges as the light source for an optoelectronic circuit. Arranging the discharges in rows permits selective collection of radiation from the display in a row by a single optical wave guide. A failure of any particular device or a few devices in such an array results in little change in overall light production. As an additional advantage, the incoherent light sources of the invention do not require mirrors and are less sensitive to materials degradation over the operational life of the device than coherent laser sources often used in optoelectronic applications. Furthermore, arrays of discharges may be used to decompose toxic gases. Because of the large specific power loadings in microcavity discharges (up to 1 MW per $cm^3$ for a 20 μm diameter device), microcavity discharge arrays can serve to rectify environmentally hazardous gases and vapors or can be used to produce a useful product such as ozone.

Another embodiment of the invention provides an improved microcavity cell discharge device having a thin film, multilayered structure whereby the optical radiation from a single microdischarge or an array of microdischarges can be coupled into a planar optical wave-guide.

Another embodiment of the invention provides improved microdischarge arrays, locked in phase for providing IR radiation from FCM excited by photons from a gas discharge.

In another embodiment, there is provided a microdischarge device with an array of microcavity cells in which the microcavity extends through the substrate and electrodes are fabricated on opposite sides of the substrate, allowing gases or vapors to flow through the microdischarge cavities, such that the gases can be decomposed into a less hazardous form or converted into a more useful species.

DC microdischarge devices having a microcavity enclosing a discharge medium (gas or vapor) excited through electrical contact with a surrounding or planar substrate cathode have been produced. Hollow cathode geometries are achieved by having the microcavity penetrate the semiconductor cathode. The semiconductor electrode may also serve as a planar electrode from which the microcavity or a microchannel extends through a dielectric and planar anode.

Selection of a sufficient aperture to length ratio for the hollow cathode geometry cavity permits the device to be operated as a hollow cathode discharge a pd (pressure times discharge distance) exceeding about 20 Torr-mm. If the cathode is selected to be cylindrical in cross-section, the small diameter offered by this device, on the order of about a single micrometer to about 400 μm, enables the discharge to be operated at pressures beyond one atmosphere. In addition, the small dimensions permit efficient production in a discharge of resonance radiation, such as the 254 nm line of atomic mercury, because the device size can now be made comparable to or less than the mean distance for the absorption of a resonant photon by a ground state atom. Arrays of microdischarge cells may be used as lighting sources, flat displays, high definition flat panel television screens, sensors, and in many other devices and applications, including the remediation of toxic gases or vapors.

The planar electrode geometry of the invention is also well suited to the discharge array arrangement. In a preferred embodiment, arrays of micro channels are formed through VLSI fabrication techniques on a planar silicon electrode to produce pulsed or continuous emission from atomic rare gases and transient molecules, such as the rare gas-halide excimer xenon-monoiodide (XeI). The planar geometry includes a dielectric film to form the microcavities, preferably in the form of microchannels, and a conducting film on the dielectric serves as the anode. Microcavity holes or channels are formed through the conducting film and anode layers with standard VLSI fabrication techniques, e.g., photolithography, plasma and wet etching, etc., so that the underlying semiconductor cathode is exposed.

The plasma microdischarge display can accommodate a flexible back plane structure because it is possible to connect to the microdischarge cells through the back plane and because the cells allow simple interconnect.

A microdischarge display may be manufactured by etching tiny wells into a silicon substrate. Because the substrate is small and made of silicon it is an ideal location to put an array of active components such as transistors.

Fluorescent Conversion Material

The FCM is added to the inner or outer part of the microdischarge cell. The FCM may also be incorporated in the shell. In one embodiment, the cell is made out of the FCM. The FCM may comprise any suitable inorganic and/or organic substances that emit IR when excited by photons from the gas discharge. The organic and/or inorganic FCM may be added directly to the cell material or composition during or after cell formation using thin film and/or thick film processes. In one embodiment of this invention, the fluorescent conversion material is a rare earth doped chalcogenide material including a glass. A chalcogenide material is one containing a chalcogenide element (sulfur, selenium, or tellurium) as the substantial constituent. The rare earth dopant is selected from one or more members of Group IIIB Periodic Table, the Lanthanide Series, and the Actinide Series, particularly Sc, Y, La, Ce, Pr, Nd, Pm, Sm, Eu, Gd, Tb, Ac, Th, Pa, and U.

The following references relate to chalcogenide materials, and are incorporated herein by reference: U.S. Pat. No. 5,629,953 (Bishop et al.); U.S. Pat. No. 6,504,645 (Lenz et al.); U.S. Pat. No. 6,928,227 (Shaw et al.); U.S. Pat. No. 7,133,590 (Shaw et al.); and U.S. Patent Application 2006/0251369 (Shaw et al.).

FCM possess the ability to absorb plasma discharge emitted radiation of a first wavelength and then, through a process of non-radiative and radiative transitions, emit one or more photons at a second longer wavelength. A preferred FCM embodiment for this conversion for IR light radiation generation comprises a host material of a chalcogenide glass doped with rare earth ions. Chalcogenide glasses are composed of the chalcogen elements, S, Se, and Te with mid-wave IR (MWIR) and long-wave IR (LWIR) transparencies up to 20 microns wavelength. Chalcogenide glass is highly transparent to IR radiation with many efficient formulations including bulk glasses such as chalcogenides, tellurides, fluorides, silicates, and chelates; as well as crystals such as $YLiF_4$, PaYF, $BaY_2F_8$. One preferred rare earth doped chalcogenide glass FCM contains the trivalent rare earth ion Praseodymium ($Pr^{3+}$) as a dopant. Other rare earth doped chalcogenide glass FCM formulations including but not limited to Europium ($Eu^{3+}$) may also be used.

When fabricated in into a display comprising a host material of chalcogenide glass doped with trivalent rare earth elements such as $Pr^{3+}$, an FCM may be produced that will down convert visible and near IR light wavelengths to longer wavelength IR wavelength emissions. The pumping energy absorbed by the FCM is reradiated as a longer IR wavelength emission in proportion to the intensity of the pumping energy waveform.

A number of the rare earth ions have electronic transitions that provide for emissions in MWIR and LWIR wavelengths and effectively convert visible and near-IR used as dopants in chalcogenide glass. By contrast, when rare earth dopants are used in silica glass, MWIR and LWIR transitions of the rare earth ions are quenched and do not produce MWIR and LWIR light. In chalcogenide glass, these transitions are active and exhibit broadband emissions when optically pumped in near-IR wavelengths by plasma emissions. Thus, rare earth doped chalcogenide glass can be utilized to transform near IR plasma emissions into bright MWIR and LWIR light.

Rare earth doped chalcogenide glass also has a high non-linearities, allowing its use as nonlinear a conversion source that can act as a broadband supercontinuum conversion source spanning hundreds of nanometers. The broadband transparency of chalcogenide glass provides the means to provide supercontinuum IR sources which cover large portions of the MWIR and LWIR spectrum. Super continuum IR imagery is especially useful for the evaluating, testing and calibrating of IR sensors for real world broadband environment.

DETAILED DESCRIPTION OF THE DRAWINGS

Figure 1:
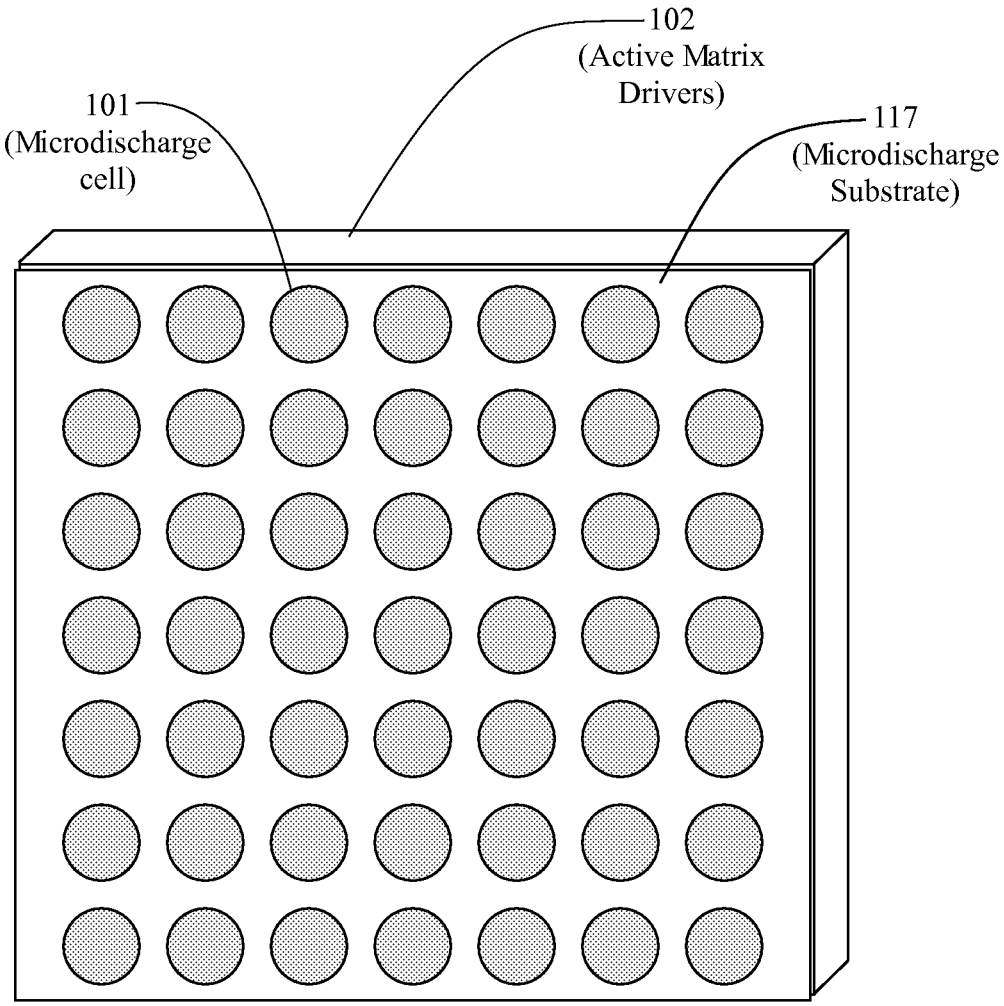
FIG. 1 is a front view of a microdischarge device with an active backplane containing at least one active electronic driver device per pixel element.

FIG. 1 is a front view of a microdischarge device with an active backplane containing at least one active electronic driver device per pixel element. Microdischarge cells 101 are contained on one side of microdischarge substrate 117 and active matrix driver circuits 102 are contained on the other side. The device contains FCM that produces IR when excited by photons from the gas discharge.

Figure 2:
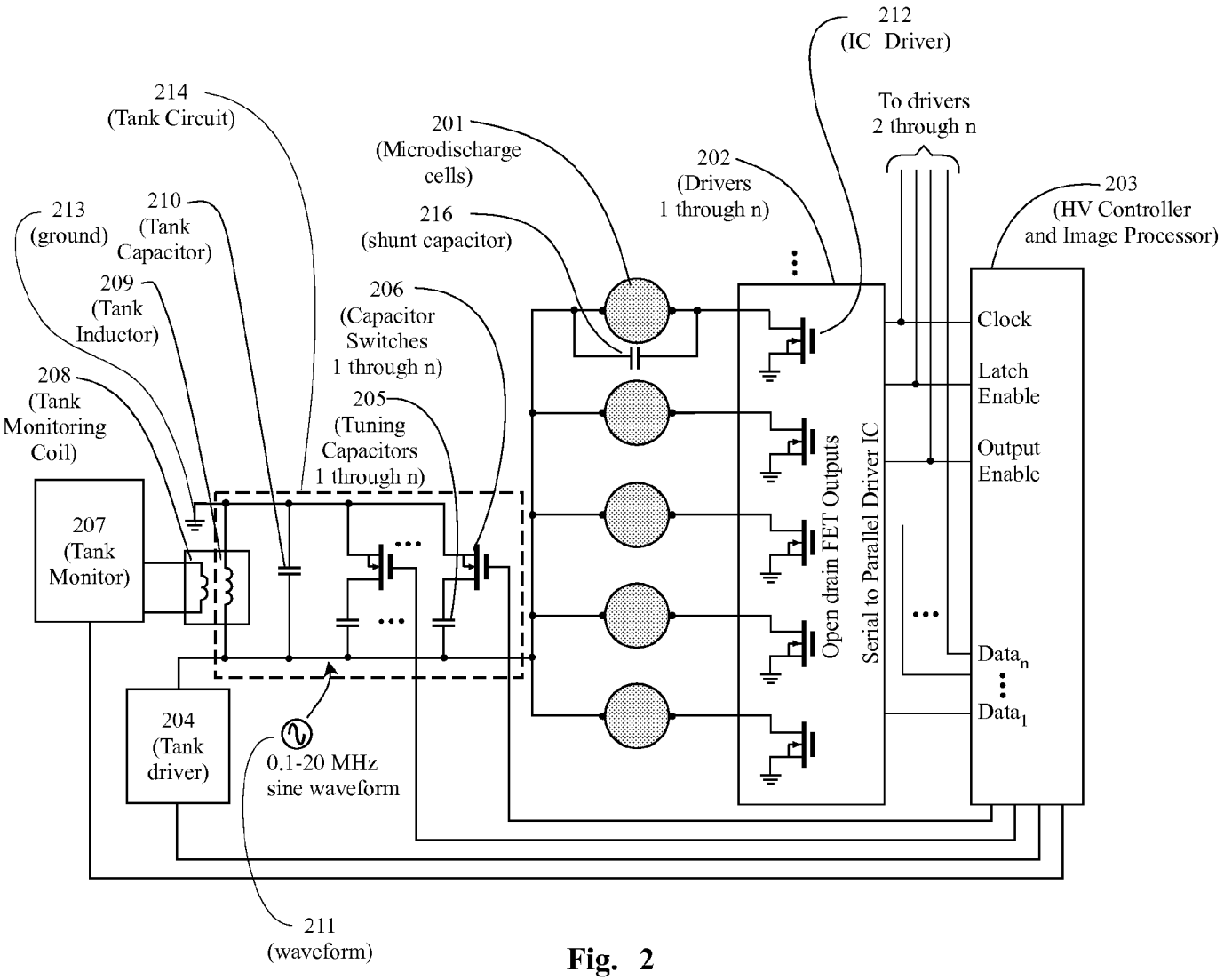
FIG. 2 is a schematic of an AC microdischarge device containing an active backplane containing at least one active electronic driver device per pixel element.

FIG. 2 is a schematic of an AC embodiment of a microdischarge device containing FCM and an active backplane containing at least one active electronic driver device per pixel element. In this embodiment electrodes in the microdischarge cells are not in direct contact with the ionizing gas but rather isolated from it by a layer of dielectric material.

FIG. 2 is a schematic of one embodiment of a microdischarge array driver circuit providing microsecond-by-microsecond control of over the discharge of each microdischarge cell. This level of control may provide a high-frequency sustain of 1 MHz or greater so as to provide a continuous plasma discharge and the presence of free electrons.

Microdischarge cells 201 are driven by a plurality of open drain FET circuits that individually control the operation of each microdischarge cell. A high voltage sine waveform 211, triangle, or sloped square wave of from about 0.1 to 5 MHz (that exceeds the microdischarge on voltage) is applied to one electrode of all the microdischarge cells 201. Another electrode of each microdischarge cell 201 is attached to a high voltage transistor array 202 outputs. The outputs 202 are most advantageously an open drain output type so that there are little or no switching losses when the ON/OFF state of the integrated transistors is changed. The sine or triangle waveform 211 has a direct or indirect reference to ground 213. The high voltage transistor array 212 reference is directly or indirectly connected to ground 213 to complete a current path for all microdischarge cells 201. A single or multiple transistor array, also known as a tank driver 204 drives the high voltage buss waveform 211 of all microdischarge cells. If an LC tank circuit 214 is utilized, the transistor circuit 204 adds energy to the high voltage/frequency 214 circuit in a most efficient way via zero voltage switching techniques. If the driver IC output 202 attached to a particular microdischarge cell is on, the full peak-to-peak high voltage waveform 211 is applied across that microdischarge cell 201 and if the voltage is high enough the microdischarge cell 201 will be on/discharging and producing radiation of various wavelengths. If the open drain output 202 is off, the series current will be greatly reduced, the voltage across the driver IC output will be increased, the voltage across the microdischarge cell will be decreased relative to its shunt capacitance and the light from the microdischarge cell will be greatly reduced or terminated relative to the voltage vs. discharge characteristic of the microdischarge cell 201. Driver IC 202 ON/OFF output states are most advantageously changed at a particular phase relative to the high voltage waveform 211 when the voltage across the IC 202 output is minimal. In an LC Tank drive system the phase of the sine wave is feed back to the image controller 203 so that the driver IC's output 202 is synchronized to the high voltage waveform 211. As more or less driver outputs are on during any sub-field the apparent capacitance of the main LC Tank circuit 214 is changed with an associated frequency shift. Therefore the controller 203 may switch in and out compensating parallel capacitors as needed on a predictive look-up table and/or frequency-monitoring basis. Driver chips 212 should have high voltage and low capacitance outputs. Low output impedance is ideal, but not as critical as high voltage and low capacitance. The driver output device 202 should be a FET with no series diode because it must conduct in both directions when the microdischarge cell is ON. Shunt capacitance 216 across each microdischarge cell should be enough to guarantee that the microdischarge cell will turn off when the driver chip 202 turns off. Since the driver IC's 212 are most likely referenced to ground the high excitation voltage 211 should be symmetrically positive and negative about ground to reduce the maximum voltage across the microdischarge cells. Otherwise, if the high voltage drive circuits 204, 205, 206, 207, 208, 209, 210 could also be ground referenced a component cost reduction could be realized.

Figure 3:
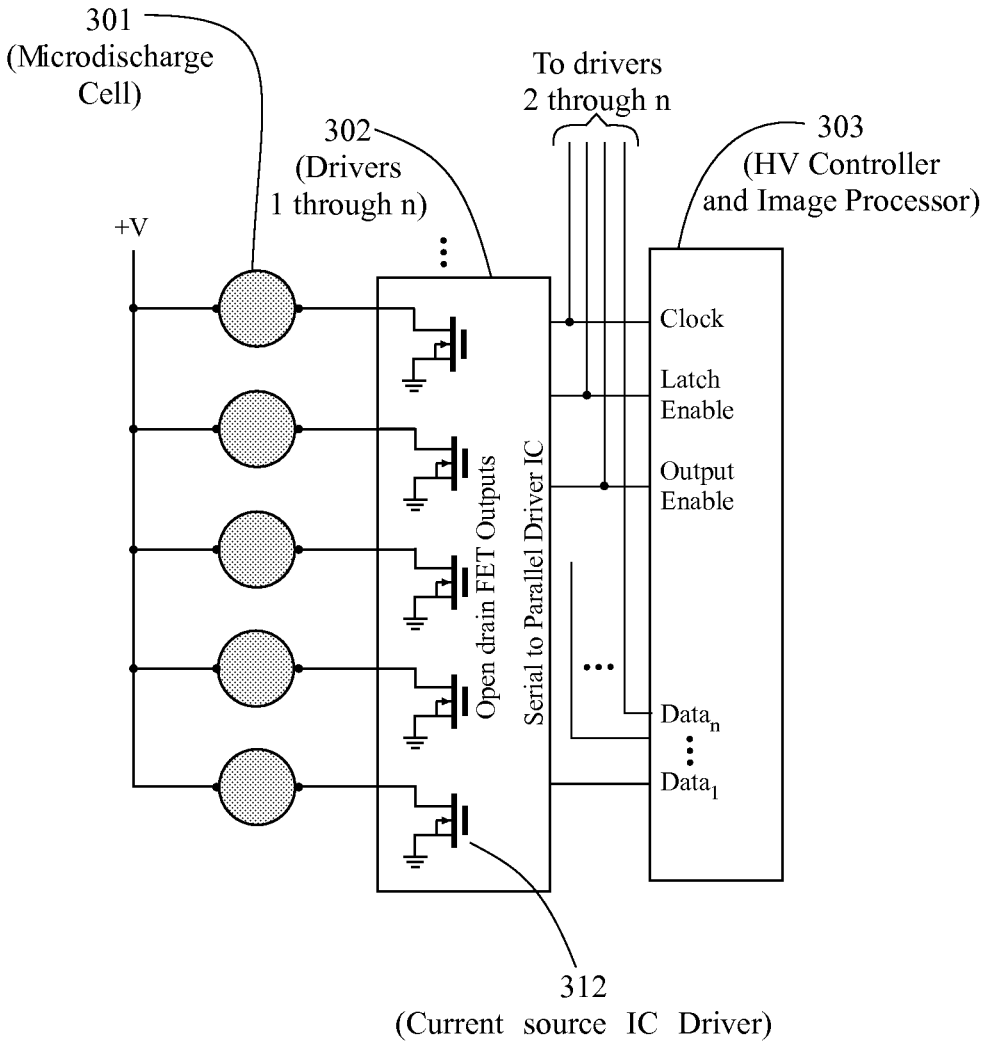
FIG. 3 is a schematic of one embodiment of a microdischarge device layout with an active backplane containing at least one active electronic driver device per pixel element.

FIG. 3 is a schematic of the DC microdischarge array driver circuit providing high-speed control of the discharge of each microdischarge cell. Microdischarge cells 301 are driven by circuit driver 302 that contains a plurality of open drain, current limited, FET circuits 312 that provide appropriate voltage waveforms individually to each plasma microcavity in response to HV controller and image processor 303.

Figure 4:
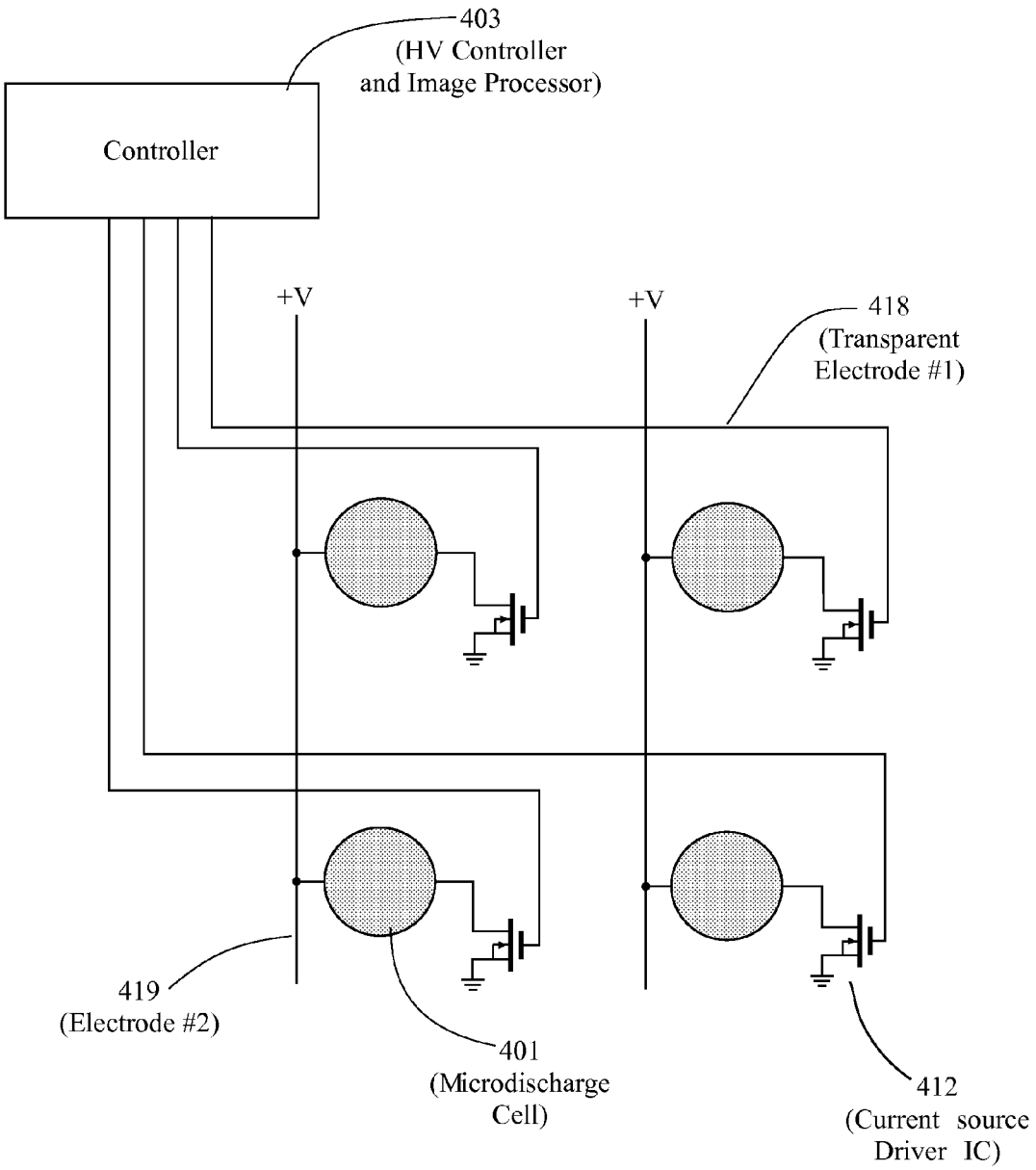
FIG. 4 is a schematic of one embodiment of a microdischarge device layout with an active backplane containing at least one active electronic driver device per pixel element.

FIG. 4 is a schematic of one embodiment of a DC microdischarge device layout with an active backplane containing at least one active electronic driver device per pixel element. One electrode of each microdischarge cell 401 is connected to electrode 419 having +V voltage. The other microdischarge electrode 418 is driven by an open drain, current limited, FET driver IC 412 in response to commands provided by HV controller and processor 403.

Figure 5:
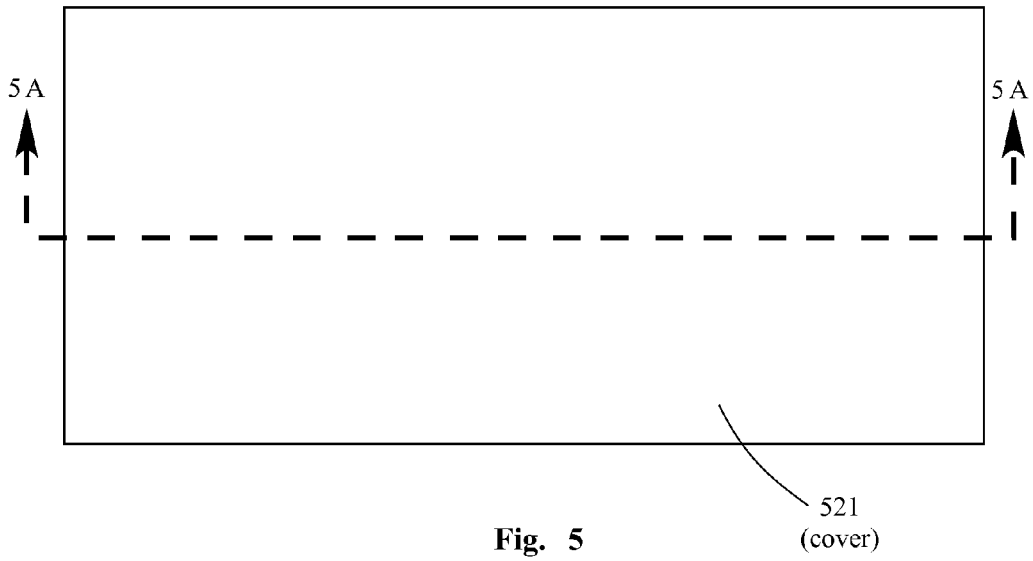
FIG. 5 is a front view of a closed cell structure microdischarge device with a transparent cover and seal.

FIG. 5 is a front view of a closed cell structure microdischarge device with a cover 521.

Figure 5A:
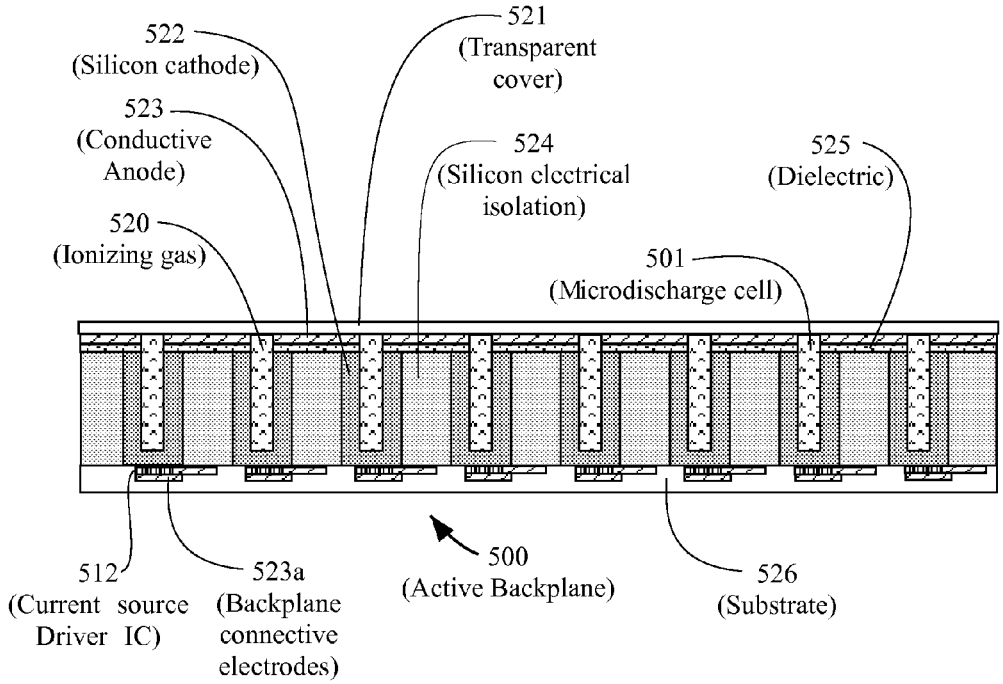
FIG. 5A is a Section 5A-5A View of a closed cell structure microdischarge device built on a silicon substrate containing an active backplane.

FIG. 5A is a Section 5A-5A View of a closed cell structure microdischarge device built on a silicon substrate 526 containing an active backplane 500. A matrix of electrically isolated conductive hollow silicon cathodes cells 522 are contained within an electrically isolating silicon 524, and isolated from conductive anodes 523 by dielectric layer 525. The hollow cavities in the silicon substrate 526 are covered and sealed by transparent cover 521 which seals the silicon cathodes 522 so as to form a matrix of closed microdischarge cavities containing mixtures of ionizing gas 520. An active matrix of electrical driver circuits 512 on the reverse side of the substrate 526 make contact with a conductive portion of the each microdischarge cathode 523, and are connected to backplane connective electrodes 523*a*. Electrodes 523*a* are, in turn, connected to appropriate voltage and control as illustrated in schematics.

Figure 6:
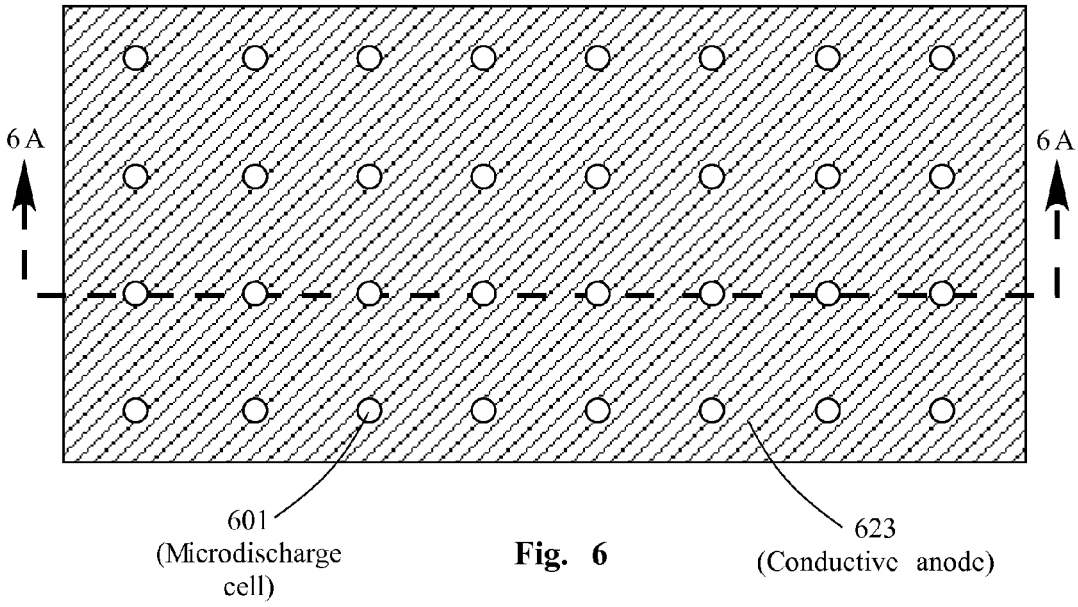
FIG. 6 is a front view of an open cell structure microdischarge device with a transparent cover removed.

FIG. 6 is a front view of an open cell structure microdischarge device with a transparent cover and seal removed revealing a conductive anode 623 and microdischarge cells 601.

Figure 6A:
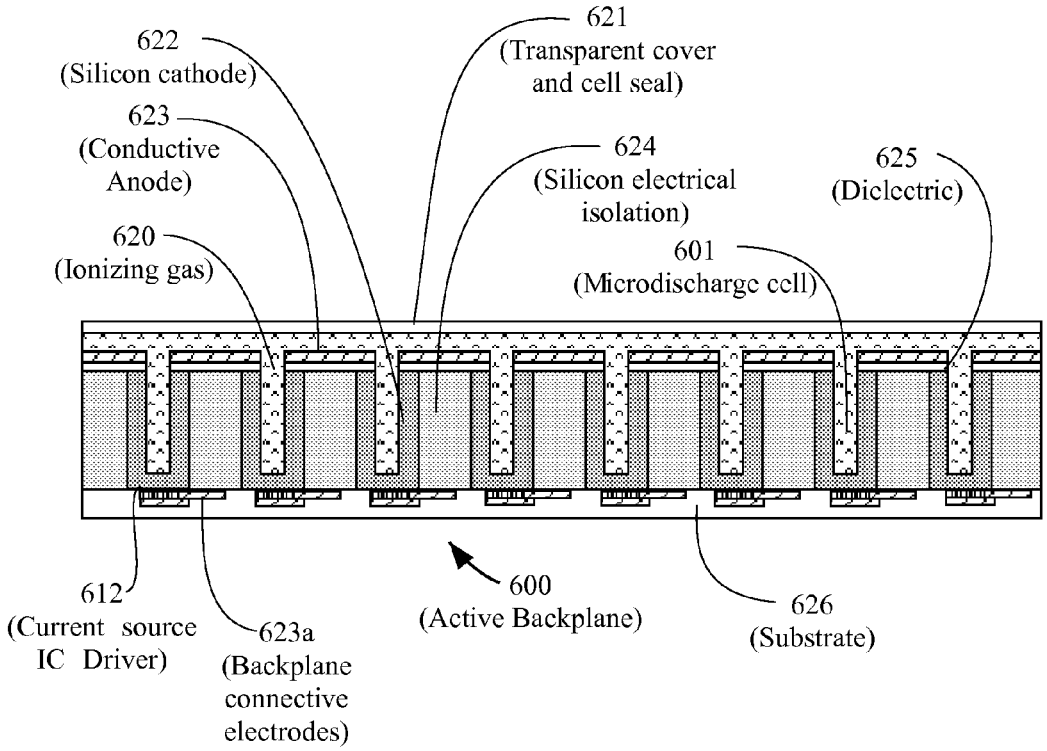
FIG. 6A is a Section 6A-6A View of an open cell structure microdischarge device built on a silicon substrate containing an active backplane.

FIG. 6A is a Section 6A-6A View of an open cell structure microdischarge device built on a silicon substrate 626 containing an active backplane 600. A matrix of electrically isolated conductive hollow silicon cathodes cells 622 are contained within an electrically isolating silicon 624, and isolated from conductive anodes 623 by dielectric layer 625. The hollow cavities in the silicon substrate 626 are covered and sealed by transparent cover and seal 621, which seals the silicon cathodes so as to form a matrix of open microdischarge cavities containing mixtures of ionizing gas. An active matrix of electrical driver circuits 612 on the reverse side of the substrate 626 make contact with a conductive portion of the each microdischarge cathode 622, and are connected to backplane connective electrodes 623*a*. Electrodes 623*a* are, in turn, connected to appropriate voltage and control as illustrated in schematics.

Figure 7:
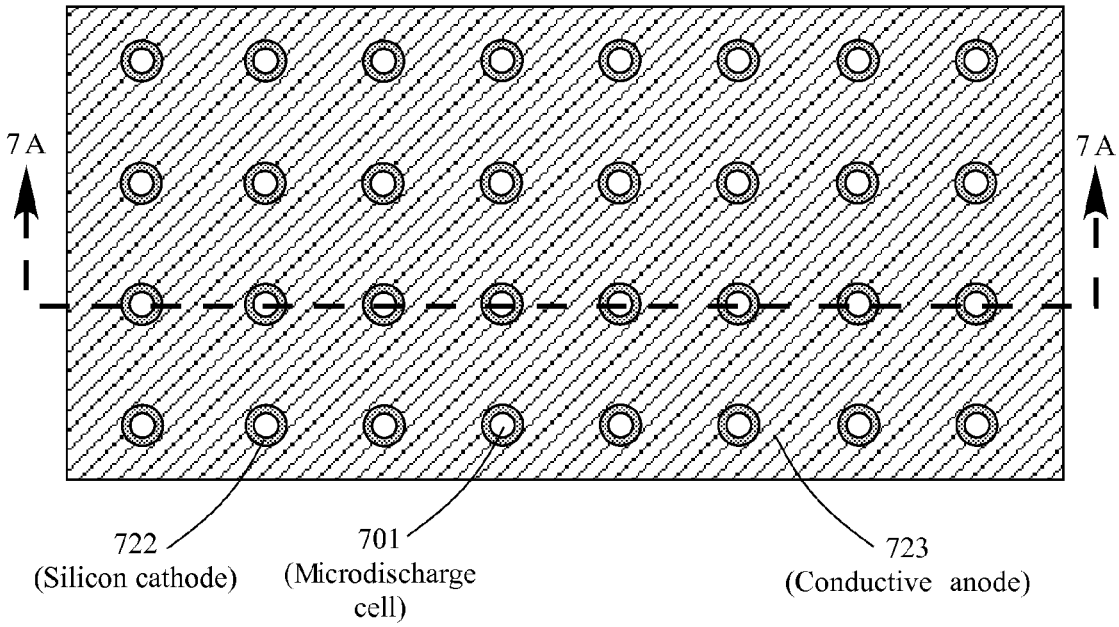
FIG. 7 is a front view of an open cell structure microdischarge device with a transparent cover removed.

FIG. 7 is a front view of an open cell structure microdischarge device with a transparent cover and seal, and dielectric removed revealing a conductive anode 723, silicon cathode 722, and microdischarge cells 701.

Figure 7A:
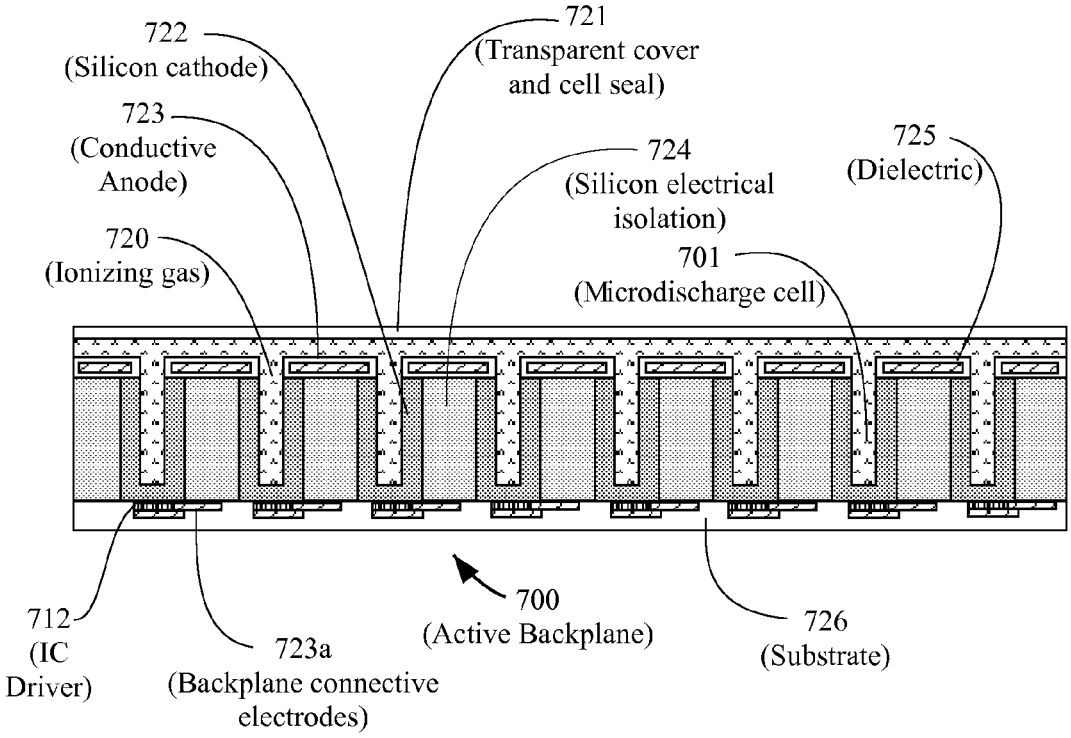
FIG. 7A is a Section 7A-7A View of an open cell structure microdischarge device built on a silicon substrate containing an active backplane.

FIG. 7A is a Section 7A-7A View of an open cell structure microdischarge device built on a silicon substrate 726 containing an active backplane 700. A matrix of electrically isolated conductive hollow silicon cathodes cells 722 are contained within an electrically isolating silicon 724, and isolated from conductive anodes 723 by dielectric layer 725. The hollow cavities in the silicon substrate are covered and sealed by transparent cover and seal 721, which seals the silicon cathodes so as to form a matrix of open microdischarge cavities containing mixtures of ionizing gas 720. An active matrix of electrical driver circuits 712 on the reverse side of the substrate 726 make contact with a conductive portion of the each microdischarge cathode 722, and are connected to backplane connective electrodes 723*a*. Electrodes 723*a* are, in turn, connected to appropriate voltage and control as illustrated in schematics.

Figure 8:
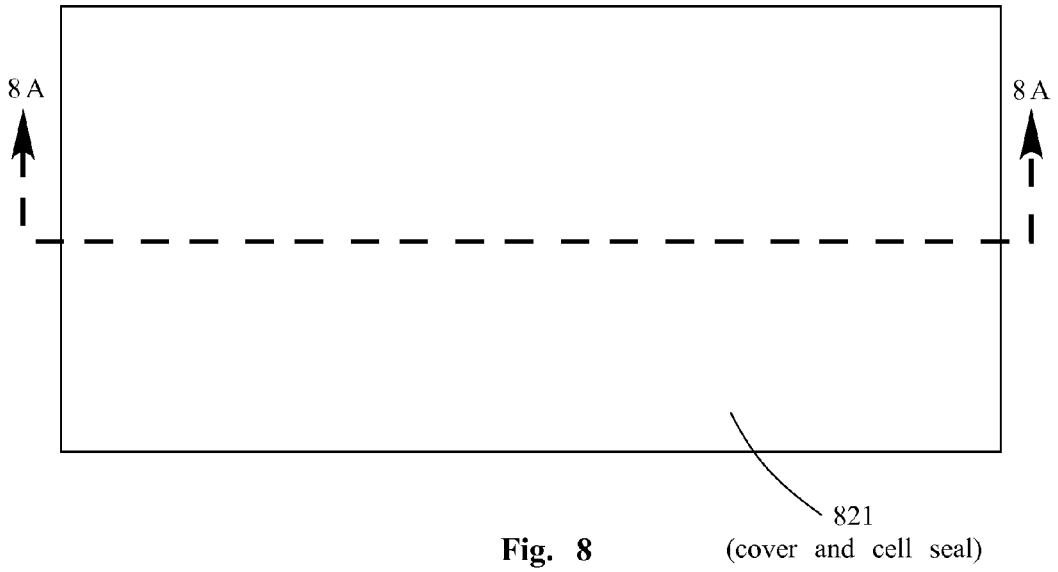
FIG. 8 is a front view of a closed cell structure microdischarge device with a transparent cover and seal.

FIG. 8 is a front view of a closed cell structure microdischarge device with a transparent cover 821.

Figure 8A:
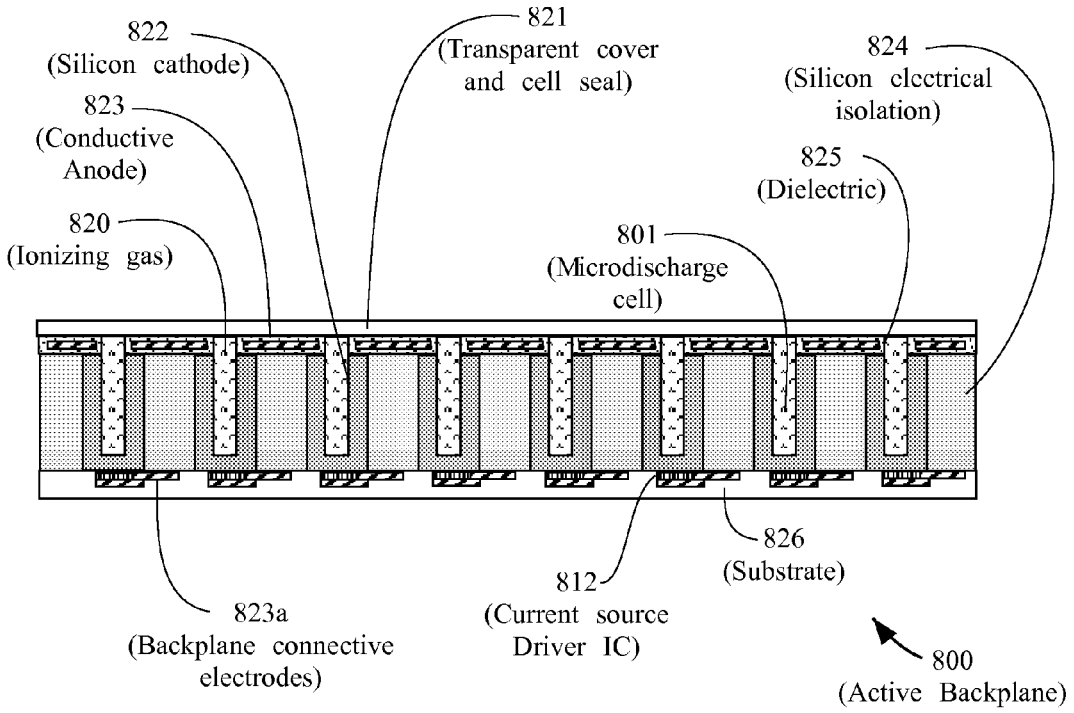
FIG. 8A is a Section 8A-8A View of a closed cell structure microdischarge antenna device built on a silicon substrate containing an active backplane.

FIG. 8A is a Section 8A-8A View of a closed cell structure microdischarge device built on a silicon substrate 826 containing an active backplane 800 and microdischarge cells 801. A matrix of electrically isolated conductive hollow silicon cathode cells 822 are contained within an electrically isolating silicon 824, and isolated from conductive anodes 823 by dielectric layer 825. The hollow cavities in the silicon substrate 826 are covered and sealed by transparent cover 821 which seals the silicon cathodes 822 so as to form a matrix of closed microdischarge cavities containing mixtures of ionizing gas 820. An active matrix of electrical driver circuits 812 on the reverse side of the substrate 826 make contact with a conductive portion of the each microdischarge cathode 823, and are connected to backplane connective electrodes 823*a*. Electrodes 823*a* are, in turn, connected to appropriate voltage and control as illustrated in schematics.

Substrate

In accordance with various embodiments of this invention, the microdischarge substrate and etched microcavity cells may be comprised of a single substrate or dual substrate device with flexible, semi-flexible, or rigid substrates. The substrate may be opaque or transparent. In some embodiments, there may be used multiple substrates of three or more. Substrates may be flexible films, such as a polymeric film substrate. The flexible substrate may also be made of metallic materials alone or incorporated into a polymeric substrate. Alternatively or in addition, one or both substrates may be made of an optically transparent thermoplastic polymeric material. Examples of suitable such materials are polycarbonate, polyvinyl chloride, polystyrene, polymethyl methacrylate, polyurethane polyimide, polyester, and cyclic polyolefin polymers. More broadly, the substrates may include a flexible plastic such as a material selected from the group consisting of polyether sulfone (PES), polyester terephihalate, polyethylene terephihalate (PET) polyethylene naphtholate, polycarbonate, polybutylene terephihalate, polyphenylene sulfide (PPS), polypropylene, polyester, aramid, polyamide-imide (PAI), polyimide, aromatic polyimides, polyetherimide, acrylonitrile butadiene styrene, and polyvinyl chloride, as disclosed in U.S. Patent Application 2004/0179145 (Jacobsen et al.), incorporated herein by reference.

Alternatively, one or both of the substrates may be made of a rigid material. For example, one or both of the substrates may be a glass substrate. The glass may be a conventionally available glass, for example having a thickness of approximately 0.2-1 mm. Alternatively, other suitable transparent materials may be used, such as a rigid plastic or a plastic film. The plastic film may have a high glass transition temperature, for example above 65° C., and may have a transparency greater than 85% at 530 nm.

Each substrate may comprise a single layer or multiple layers of the same or different materials. Composites including mixtures, dispersions, suspensions, and so forth are contemplated.

Further details regarding substrates and substrate materials may be found in International Publications Nos. WO 00/46854, WO 00/49421, WO 00/49658, WO 00/55915, and WO 00/55916, the entire disclosures of which are herein incorporated by reference. Apparatus, methods, and compositions for producing flexible substrates are disclosed in U.S. Pat. No. 5,469,020 (Herrick), U.S. Pat. No. 6,274,508 (Jacobsen et al.), U.S. Pat. No. 6,281,038 (Jacobsen et al.), U.S. Pat. No. 6,316,278 (Jacobsen et al.), U.S. Pat. No. 6,468,638 (Jacobsen et al.), U.S. Pat. No. 6,555,408 (Jacobsen et al.), U.S. Pat. No. 6,590,346 (Hadley et al.), U.S. Pat. No. 6,606,247 (Credelle et al.), U.S. Pat. No. 6,665,044 (Jacobsen et al.), and U.S. Pat. No. 6,683,663 (Hadley et al.), all of which are incorporated herein by reference.

The microdischarge substrate may be constructed of any suitable inorganic compounds of metals and/or metalloids, including mixtures or combinations thereof. Contemplated inorganic compounds include the oxides, carbides, nitrides, nitrates, silicates, silicides, aluminates, phosphates, sulphates, sulfides, borates, and borides.

The metals and/or metalloids are selected from magnesium, calcium, strontium, barium, yttrium, lanthanum, cerium, neodymium, gadolinium, terbium, erbium, thorium, titanium, zirconium, hafnium, vanadium, niobium, tantalum, chromium, molybdenum, tungsten, manganese, rhenium, iron, ruthenium, osmium, cobalt, rhodium, iridium, nickel, copper, silver, zinc, cadmium, boron, aluminum, gallium, indium, thallium, carbon, silicon, germanium, tin, lead, phosphorus, and bismuth.

Inorganic materials suitable for use are magnesium oxide(s), aluminum oxide(s), zirconium oxide(s), and silicon carbide(s) such as MgO, $Al_2O_3$, $ZrO_2$, $SiO_2$, and/or SiC.

In one embodiment there is used fused particles of glass, ceramic, glass ceramic, refractory, fused silica, quartz, or like amorphous and/or crystalline materials including mixtures of such. In one preferred embodiment, a ceramic material is selected based on its transmissivity to light after firing. This may include selecting ceramic material with various optical cutoff frequencies to produce various colors. One preferred material contemplated for this application is aluminum oxide. Aluminum oxide is transmissive from the UV range to the IR range. Because it is transmissive in the UV range, phosphors excited by UV may be applied to the exterior of the substrate to produce various colors. The application of the phosphor to the exterior of the substrate may be executed by any suitable means. There may be several layers or coatings of phosphors, each of a different composition, applied to the exterior.

In one specific embodiment of this invention, the substrate is made of an aluminate silicate or contains a layer of aluminate silicate. When the ionizable gas mixture contains helium, the aluminate silicate is especially beneficial in preventing the escape of helium. It is also contemplated that the substrate may be made of lead silicates, lead phosphates, lead oxides, borosilicates, alkali silicates, aluminum oxides, and pure vitreous silica.

The substrate may be made in whole or in part from one or more materials such as magnesium oxide having a sufficient Townsend coefficient. These include inorganic compounds of magnesium, calcium, strontium, barium, gallium, lead, aluminum, boron, and the rare earths especially lanthanum, cerium, actinium, and thorium. The contemplated inorganic compounds include oxides, carbides, nitrides, nitrates, silicates, aluminates, phosphates, borates, and other inorganic compounds of the above and other elements.

The substrate may also contain or be partially or wholly constructed of luminescent materials such as inorganic phosphor(s). The phosphor may be a continuous or discontinuous layer or coating on the interior or exterior of the substrate. Phosphor particles may also be introduced inside the substrate or embedded within the substrate. Luminescent quantum dots may also be incorporated into the substrate.

Conductive Substrate

In a DC PDP the substrate may be made of a conductive material, for example, as disclosed in the following prior art incorporated herein by reference. Likewise, conductive materials particularly metals or metalloid oxides may be applied to the electrodes, especially the cathode.

U.S. Pat. No. 6,797,662 (Jaffrey) discloses electrically conductive ceramics. A metal oxide ceramic material such as alumina or chromia is rendered electrically conductive through its thickness by the incorporation of silver into the material.

U.S. Pat. No. 6,631,062 (Minamisawa et al.) discloses an electrically conductive ceramic material and a process of producing same. The material comprises a compound containing at least one element belonging to Group 3A of the Periodic Table and $TiO_{2-x}$ ($0<x<2$) in a range such that the $TiO_{2-x}$ ($0<x<2$) accounts for 1 to 60 wt % of the total amount of the ceramics, and at least part of the compound and the $TiO_{2-x}$ form a composite oxide.

U.S. Pat. No. 6,531,408 (Iwata et al.) discloses a method for growing zinc oxide based semi-conductor layers.

U.S. Pat. No. 6,146,552 (Iga et al.) discloses a method for producing zinc oxide varistors for low and high voltages.

U.S. Pat. No. 5,795,502 (Terashi et al.) discloses an electrically conducting ceramic and/or process for producing the same. The electrically conducting ceramics have as a chief crystalline phase a perovskite crystalline phase containing La, Cr and Mg and further having, in addition to the chief crystalline phase, an oxide phase containing La, wherein when the atomic ratios among the rare earth element, Mg and Cr in the said chief crystalline phase are represented by the following formula, $$R:Mg:Cr=x:y:z$$

wherein R denotes rare earth elements at least part of which being La, the atomic ratios among the rare earth element, Mg and Cr contained in the whole ceramics are represented by the following formula, $$R:Mg:Cr=(x+u):(y+v):z$$

wherein R, x to z are as defined above, and u and v are the numbers satisfying the following formulas, $$0.0001 \le \frac{u}{(x+y+z)} \le 0.20$$

$$0.01 \le \frac{(y+v)}{(x+y+z)} \le 0.60 \text{ And } 0 \le v$$

The ceramics are dense, exhibit excellent sintering properties at low temperatures, have high electrical conductivity, and remain stable in a reducing atmosphere.

U.S. Pat. Nos. 5,770,113 and 5,739,742 (Iga et al.) disclose zinc oxide compositions including methods of preparation.

U.S. Pat. No. 5,601,853 (Bednarz et al.) discloses an electrically conductive ceramic composition, which consists essentially of alumina, chromia, and magnesia, and is suitable for use as electrodes in electrostatic fiber charging applications. Ceramics are disclosed which exhibit volume resistivities of 1012 Ohm-cm or less at 20° C. and have excellent electrical stability and superior mechanical properties.

U.S. Pat. No. 5,656,203 (Mikesha) discloses electrically conductive ceramics with oxides of Al, Cr, and Mg such as alumina, chromia, and magnesia. Ceramics are disclosed which exhibit volume resistivities of 1012 ohm-cm or less at 20° C. and have excellent electrical stability and superior mechanical properties.

U.S. Pat. No. 5,604,048 (Nishihara et al.) discloses an electrically conducting ceramic having improved electrical conductivity, which comprises a perovskite-type composite oxide represented by the following formula, $$(La_{1-x-y}A_xB_y)_z(Mn_{1-u}C_u)_vO\delta$$

wherein A represents at least one type of atom selected from the group consisting of Sc, Y, Nd, Yb, Er, Gd, Sm and Dy; B represents at least one type of atom selected from the group consisting of Ba, Sr and Ca; and C represents at least one type of atom selected from the group consisting of Co, Fe, Ni, Ce, Zr, Mg, Al, Sb; and Cr, and x, y, z, u, v and δ are the numbers that satisfy the following formulas:

$$0.02 \le x \le 0.5$$

$$0.1 \le y \le 0.6$$

$$0.90 \le z \le 1.05$$

$$0 \le u \le 0.5$$

$$v = 1.0$$

U.S. Pat. No. 5,688,731 (Chatterjee et al.) discloses a ceramic composite containing doped zirconia having high electrical conductivity. These electrically conductive ceramics comprise tetragonal zirconia or a composite of zirconia-alumina and zirconium diboride.

U.S. Pat. No. 5,397,920 (Tran) discloses light transmissive electrically conductive compositions including methods of preparation.

U.S. Pat. No. 5,126,218 (Clarke) discloses a conductive ceramic substrate for batteries formed from a sub-stiochemetric titanium dioxide material. The material preferably is TiOx, where x is in the region of 1.55 to 1.95.

U.S. Pat. No. 5,066,423 (Kubo et al.) discloses a conductive ceramic sintered body substantially free from large variation of electric resistivity, which consists essentially of: (a) a silicon nitride-base ceramic as a matrix; (b) 10-70 volume % of a first conductive material which consists of one or more conductive compounds selected from carbides, nitrides, oxides and their composite compounds of transition metals in Groups IVa, Va and VIa of the Periodic Table; and (c) 0.1-50 volume % of a second conductive material consisting of SiC; the first conductive material and the second conductive material serving to form paths for electric conduction.

U.S. Pat. No. 4,795,723 (Nishikawa et al.) discloses an electrically conductive hot press sintered ceramic comprising boron nitride, titanium diboride and aluminum nitride and having a flexural strength of at least 900 kg/cm$^2$, a specific resistance of from 300 to less than 2,500 μΩcm and less anisotropy.

U.S. Pat. No. 4,645,622 (Keck) discloses an electrically conductive ceramic having the composition $La_xCa_yMnO_3+\Delta$ characterized by x=0.44 to 0.48, Y=0.42 to 0.50 and the sum of the mol numbers of La and Ca is between 1 to 15% (preferably about 10%) smaller than the mol number of Mn.

U.S. Pat. No. 4,113,928 (Virkar et al.) discloses the preparation of dense, high strength, and electrically conductive ceramics containing β"-alumina. Methods of preparing a dense and strong polycrystalline β"-alumina-containing ceramic body exhibiting an electrical resistivity for sodium ion conduction at 300° C. of 9 ohm-cm or lower obtained directly after sintering and having a controlled fine microstructure exhibiting a uniform grain size under 50 micrometers. The reference discloses methods of uniformly distributing selected metal ions having a valence not greater than 2, e.g. lithium or magnesium, uniformly throughout the beta-type alumina composition prior to sintering to form β"-alumina. This uniform distribution allows more complete conversion of β-alumina to β"-alumina during sintering. As a result, the polycrystalline β"-alumina containing ceramic bodies obtained by these methods exhibit high density, low porosity, high strength, fine grain size (i.e. no grains over 25-50 micrometers with an average size under 5-10 micrometers), low electrical resistivity and a high resistance to degradation by water vapor in an ambient atmosphere.

Secondary Electron Emission

Secondary electron emission (Townsend coefficient) materials may be incorporated into the substrate, microcavity, and/or the electrodes. The use of secondary electron emission materials in a plasma display is well known in the prior art and is disclosed in U.S. Pat. No. 3,716,742 issued to Nakayama et al., incorporated herein by reference. The use of Group Ha compounds including magnesium oxide is disclosed in U.S. Pat. Nos. 3,836,393 and 3,846,171 incorporated herein by reference. The use of rare earth compounds in an AC plasma display is disclosed in U.S. Pat. Nos. 4,126,807, 4,126,809, and 4,494,038, all issued to Donald K. Wedding et al., and incorporated herein by reference. Lead oxide may also be used as a secondary electron material. Mixtures of secondary electron emission materials may be used.

In one embodiment and mode contemplated for the practice of this invention, a secondary electron emission material such as magnesium oxide is applied to part or all of the internal surface of the substrate and/or to the electrodes, especially the cathode. The secondary electron emission material may also be on the external surface. The thickness of the magnesium oxide may range from about 250 Angstrom Units to about 10,000 Angstrom Units (Å). The substrate may be made of a secondary electronic material such as magnesium oxide. A secondary electron material may also be dispersed or suspended as particles within the ionizable gas such as with a fluidized bed. Phosphor particles may also be dispersed or suspended in the gas such as with a fluidized bed, and may also be added to the internal or external surface of the substrate.

Magnesium oxide increases the ionization level through secondary electron emission that in turn leads to reduced gas discharge voltages. In one embodiment, the magnesium oxide is on the internal surface of the substrate and the phosphor is located on external surface of the substrate. Magnesium oxide is susceptible to contamination. To avoid contamination, gas discharge (plasma) displays are assembled in clean rooms that are expensive to construct and maintain. In traditional plasma panel production, magnesium oxide is applied to an entire open substrate surface and is vulnerable to contamination. The adding of the magnesium oxide layer to the inside of a microcavity minimizes exposure of the magnesium oxide to contamination. The magnesium oxide may be applied to the inside of the microcavity by incorporating magnesium vapor as part of the ionizable gases introduced into the microcavity while at an elevated temperature. The magnesium may be oxidized while at an elevated temperature.

In some embodiments, the magnesium oxide may be added as particles to the gas. Other secondary electron materials may be used in place of, or in combination with, magnesium oxide. In one embodiment hereof, the secondary electron material such as magnesium oxide or any other selected material such as magnesium to be oxidized in situ is introduced into the gas by means of a fluidized bed. Other materials such as phosphor particles or vapor may also be introduced into the gas with a fluid bed or other means.

Ionizable Gas

The microcavity as used in the practice of this invention contains one or more ionizable gas components. In the practice of this invention, the gas is selected to emit photons and excite the FCM and produce IR.

The UV spectrum is divided into regions. The near UV region is a spectrum ranging from about 340 to 450 nm (nanometers). The mid or deep UV region is a spectrum ranging from about 225 to 340 nm. The vacuum UV region is a spectrum ranging from about 100 to 225 nm. The PDP prior art has used vacuum UV to excite photoluminescent phosphors. In the practice of this invention, it is contemplated using a gas, which provides UV over the entire spectrum ranging from about 100 to about 450 nm. The PDP operates with greater efficiency at the higher range of the UV spectrum, such as in the mid UV and/or near UV spectrum. In one preferred embodiment, there is selected a gas which emits gas discharge photons in the near UV range. In another embodiment, there is selected a gas which emits gas discharge photons in the mid UV range. In one embodiment, the selected gas emits photons from the upper part of the mid UV range through the near UV range, about 275 nm to 450 nm.

As used herein, ionizable gas or gas means one or more gas components. In the practice of this invention, the gas is typically selected from a mixture of the noble or rare gases of neon, argon, xenon, krypton, helium, and/or radon. The rare gas may be a Penning gas mixture. Other contemplated gases include nitrogen, $CO_2$, CO, mercury, halogens, excimers, oxygen, hydrogen, and mixtures thereof. Isotopes of the above and other gases are contemplated. These include isotopes of helium such as helium-3, isotopes of hydrogen such as deuterium (heavy hydrogen), tritium ($T^3$) and DT, isotopes of the rare gases such as xenon-129, and isotopes of oxygen such as oxygen-18. Other isotopes include deuterated gases such as deuterated ammonia ($ND_3$) and deuterated silane ($SiD_4$).

In one embodiment, a two-component gas mixture (or composition) is used. Such mixtures include argon and xenon, argon and neon, argon and helium, argon and krypton, xenon and neon, xenon and helium, xenon and krypton, neon and helium, neon and krypton, and helium and krypton. Specific two-component gas mixtures (compositions) include about 5% to 90% atoms of argon with the balance xenon. Another two-component gas mixture is a mother gas of neon containing 0.05% to 15% atoms of xenon, argon, or krypton. This can also be a three-component gas, four-component gas, or five-component gas by using quantities of an additional gas or gases selected from xenon, argon, krypton, and/or helium. In another embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference. Other three-component gas mixtures include argon-helium-xenon, krypton-neon-xenon, and krypton-helium-xenon.

U.S. Pat. No. 4,081,712 (Bode et al.), incorporated herein by reference, discloses the addition of helium to a gaseous medium of 90% to 99.99% atoms of neon and 10% to 0.01% atoms of argon, xenon, and/or krypton. In one embodiment, there is used a high concentration of helium with the balance selected from one or more gases of neon, argon, xenon, and nitrogen as disclosed in U.S. Pat. No. 6,285,129 (Park) and incorporated herein by reference.

A high concentration of xenon may also be used with one or more other gases as disclosed in U.S. Pat. No. 5,770,921 (Aoki et al.), incorporated herein by reference. Pure neon may be used and the microdischarge cell operated without memory margin using the architecture disclosed by U.S. Pat. No. 3,958,151 (Yano) discussed above and incorporated herein by reference.

Excimers

Excimer gases may also be used as disclosed in U.S. Pat. Nos. 4,549,109 and 4,703,229 issued to Nighan et al., both incorporated herein by reference. Nighan et al. 109 and 229 disclose the use of excimer gases formed by the combination of halogens with rare gases. The halogens include fluorine, chlorine, bromine and iodine. The rare gases include helium, xenon, argon, neon, krypton and radon. Excimer gases may emit red, blue, green, or other color light in the visible range or light in the invisible range. The excimer gases may be used alone or in combination with phosphors. U.S. Pat. No. 6,628,088 (Kim et al.), incorporated herein by reference, also discloses excimer gases for a PDP.

Other Gases

Depending upon the application, a wide variety of gases are contemplated for the practice of this invention. Such other applications include gas-sensing devices for detecting radiation and radar transmissions. Such other gases include $C_2H_2$—$CF_4$—Ar mixtures as disclosed in U.S. Pat. Nos. 4,201,692 and 4,309,307 (Christophorou et al.), both incorporated herein by reference. Also contemplated are gases disclosed in U.S. Pat. No. 4,553,062 (Ballon et al.), incorporated by reference. Other gases include sulfur hexafluoride, HF, $H_2S$, $SO_2$, SO, $H_2O_2$, and so forth.

SUMMARY

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A microdischarge device comprising a substrate, a backplane, and a multiplicity of gas discharge microdischarge cells, each cell being defined by a microcavity formed in the substrate and containing an ionizable gas, at least two electrodes configured to cause a discharge in the microcavity when a potential is applied between the electrodes, each electrode being connected to electronic circuitry including one or more active components on the backplane, said device containing a fluorescent conversion substance that produces IR when excited by photons from a gas discharge.

2. The invention of claim 1 wherein at least one active electronic component is provided for each microdischarge cell.

3. The invention of claim 2 wherein said at least one active component is a transistor.

4. The invention of claim 3 wherein the transistor is a field effect transistor, an open drain field effect transistor, a bipolar transistor, or an open collector bipolar transistor.

5. The invention of claim 1 wherein at least one electrode is encapsulated with a dielectric.

6. The invention of claim 1 wherein at least one electrode is in direct contact with the gas.

7. An AC microdischarge device comprising a substrate, a backplane, and a plurality of microcavity cells containing an ionizable gas, said microcavity cells being within a surface of the substrate, at least two electrodes being in electrical contact with each cell, at least one electrode at each cell being insulated from the gas with a dielectric, each electrode being connected to electronic circuitry including one or more integrated active components on the backplane, the electrodes being configured to provide a discharge in the cell when a potential is applied between the electrodes, the device containing a fluorescent conversion material that produces IR when excited by photons from the gas discharge.

8. The invention of claim 7 wherein the integrated active component is a transistor.

9. The invention of claim 8 wherein at least one other active component is included with the transistor.

10. The invention of claim 9 wherein the other active component is a high speed shift register, addressing logic, and/or control circuitry.

11. The invention of claim 8 wherein the transistor is a field effect transistor, an open drain field effect transistor, a bipolar transistor, or an open collector bipolar transistor.

12. An AC microdischarge device comprising a substrate, a backplane, and an array of microcavity cells containing an ionizable gas, a plurality of conductive electrodes encapsulated in a dielectric and electrically connected to each cell, said encapsulated electrodes, being configured to provide a gas discharge in each microcavity cell when a voltage potential is applied between the electrodes, each electrode being connected to electronic circuitry including one or more active components on the backplane, a fluorescent conversion material being provided in the device to produce IR when excited by photons from a gas discharge.

13. The invention of claim 12 wherein the active component is a transistor.

14. The invention of claim 13 wherein the transistor is a field effect transistor, an open drain field effect transistor, a bipolar transistor, or an open collector bipolar transistor.

15. The invention of claim 13 wherein there is at least one other active component with the transistor.

16. The invention of claim 15 wherein the other active component is a high speed shift register, addressing logic and/or control circuitry.

* * * * *